US005573115A

United States Patent [19]

Fuller

[11] Patent Number: 5,573,115

[45] Date of Patent: Nov. 12, 1996

[54] MERCHANDISING AND SHIPPING BOX

[75] Inventor: William A. Fuller, Springfield, Ohio

[73] Assignee: Vining Industries, Inc., Springfield, Ohio

[21] Appl. No.: 508,436

[22] Filed: Jul. 28, 1995

[51] Int. Cl.[6] ..... B65D 85/20

[52] U.S. Cl. ..... 206/362.4; 206/362; 206/780; 211/65

[58] Field of Search ..... 206/45.14, 361–362, 206/362.1–362.4, 15.2–15.3, 485, 589; 211/70.6, 65, 66

[56] References Cited

U.S. PATENT DOCUMENTS

| | | | |
|---|---|---|---|
| 226,891 | 4/1880 | Tym . | |
| 453,969 | 6/1891 | Flack | 211/65 |
| 2,269,499 | 2/1953 | Welshenbach | 211/60 |
| 2,423,292 | 7/1947 | Brown | 211/65 |
| 3,780,874 | 12/1973 | Stacy, Sr. | 211/65 |
| 3,819,034 | 6/1974 | Clark | 206/361 |
| 4,134,525 | 1/1979 | Respoli | 211/65 |
| 4,576,291 | 3/1986 | Stein | 211/49.1 |
| 4,947,998 | 8/1990 | Smeller | 211/70.6 |
| 5,085,316 | 2/1992 | Pearce et al. | 206/362.4 |
| 5,092,463 | 3/1992 | Dees | 206/373 |
| 5,350,111 | 9/1994 | Vosbikian | 229/162 |
| 5,363,870 | 11/1994 | Doyon | 206/15.3 |

FOREIGN PATENT DOCUMENTS

| | | | |
|---|---|---|---|
| 446626 | 3/1968 | Switzerland | 211/65 |

*Primary Examiner*—Jacob K. Ackun
*Assistant Examiner*—Luan K. Bui
*Attorney, Agent, or Firm*—Biebel & French

[57] ABSTRACT

A merchandising and shipping box for implements, such as mops and brooms. The box may be used for shipping the implements as well as for supporting the implements on display. The box includes opposing side panels, front and rear panels, a bottom panel and a top panel. The top panel is provided with a plurality of apertures arranged in two spaced rows, and an elongated slot extending between the two rows of apertures. The apertures are adapted to support handle portions of the implement with head portions thereof oriented upwardly, and the elongated slot is connected to an enlarged transverse slot for receiving head portions of the implements therethrough whereby the implements may be positioned within the elongated slot with the head portion oriented downwardly. The different orientations of the implements within the box facilitates viewing of the implements as well as provides a stable support for the implements while on display.

15 Claims, 3 Drawing Sheets

MERCHANDISING AND SHIPPING BOX

BACKGROUND OF THE INVENTION

1. Field of the Invention

The present invention relates to a box for merchandising and shipping implements, and more particularly, to a box which facilitates organization of implements, such as brooms and mops within the box for both shipping and display.

2. Description of the Prior Art

Elongated implements or products sold by merchants are commonly displayed in boxes wherein handle portions of the implements are positioned within the box while a head portion of the implement, such as a broom head or mop head, is located upwardly for convenient viewing by a customer. Often, the brooms or mops are shipped in the display or merchandising box, and portions of the box are removable by the merchant in order to convert the shipping box to a display box.

An example of such a box is disclosed in Vosbikian U.S. Pat. No. 5,350,111. This patent discloses a product display box useful for both shipping and displaying products wherein top and front panels of the box may be removed or folded back to enable loading of and access to products within the box.

One problem associated with known shipping and display boxes relates to the stability of the box with the products located therein. Often, merchants prefer to orient the products with the head portion positioned upwardly and the handles positioned downwardly in order to provide an attractive display for the product and to facilitate viewing of the head portion of the product. Such an orientation of the product results in the display becoming top heavy and there being a risk of the box toppling over. Further, the products in such a display are commonly arbitrarily located within the box such that the display may have a disorganized appearance and the products may becomes entangled with each other making it difficult for consumers to remove the product from the box.

Also, even when the products are oriented with the head portion down inside the box, the products may be difficult to view while in the box in that the handles tend to lean in arbitrary directions leading to a jumbled appearance of the products in the box.

Accordingly, there is a need for a merchandising and shipping box which conveniently organizes elongated implements or products within the box for display and shipping, and which provides a stable display device for holding the products.

SUMMARY OF THE INVENTION

The present invention provides a merchandising and shipping box which is adapted to ship and display implements or products having a handle and a head portion, and is particularly suited for displaying mops and brooms.

The box of the present invention includes a pair of opposing side panels, a front panel, a back panel, a top panel and a lower support structure. The top panel is located adjacent to top edges of the side panels, front panel and back panel and includes spaced rows of apertures extending in a generally front to rear direction for receiving handles of the implements. An elongated slot is also formed in the top panel and extends between the rows of apertures for receiving handles of implements. The apertures are adapted to receive implements with the head portions thereof oriented upwardly, and the elongated slot is adapted to receive the implements with the head portions thereof oriented downwardly.

In order to facilitate insertion of the head portions through the elongated slot, a transverse slot is provided at a forward end of the elongated slot extending substantially perpendicular to the elongated slot. The transverse slot provides an enlarged slot area for receiving the implement head portions.

The implements located in the slot and having their head portions oriented downwardly provide a weight to the base of the box for resisting tipping forces applied against the box. Further, the implements located in the rows of apertures on either side of the slot are held by the apertures in a substantially vertical orientation to avoid tipping forces which may result if the implements were permitted to lean against the sides of the box.

The front panel preferably includes a cut-out area to facilitate viewing portions of the implements located within the box.

In addition, the arrangement of the apertures and the slot ensure that the implements are maintained in an organized arrangement to thereby maintain an attractive display.

Therefore, it is an object of the present invention to provide a merchandising and shipping box for supporting implements having a handle and head portion in a stable arrangement.

It is a further object of the invention to provide a merchandising and shipping box which facilitates organized arrangement of implements within the box.

It is yet another object of the invention to provide a merchandising and shipping box which facilitates viewing of implements supported in the box.

Other objects and advantages of the invention will be apparent from the following description, the accompanying drawings and the appended claims.

DETAILED DESCRIPTION OF THE PREFERRED EMBODIMENT

Figure 1:
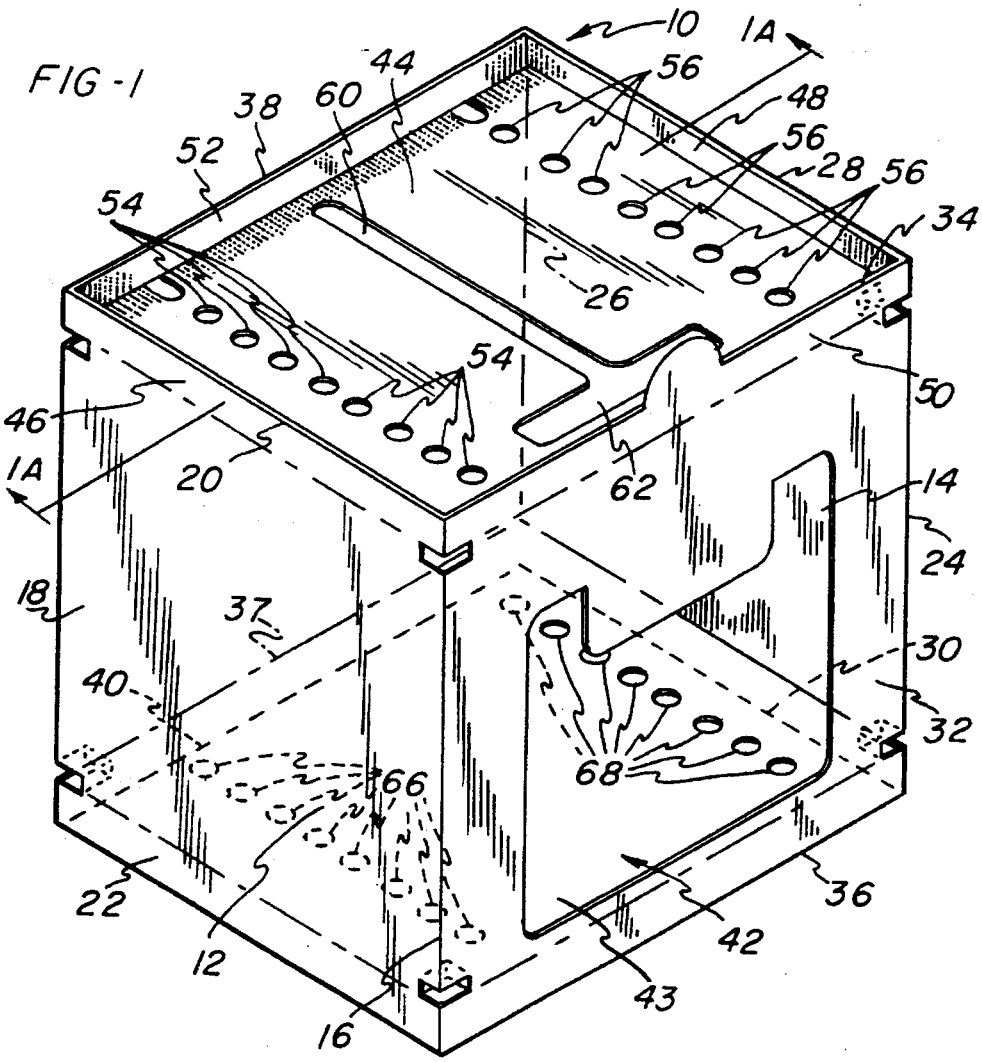
FIG. 1 is a perspective view of the merchandising and shipping box of the present invention.

Referring initially to FIG. 1, the present invention comprises a merchandising and shipping box 10 which is preferably formed of a cardboard material, such as corrugated cardboard. The box is adapted to hold elongated implements such as mops and brooms having an elongated handle and a head portion attached to one end of the handle.

The box 10 includes a pair of opposing side panels 12, 14 wherein the side panel 12 includes a front edge 16, a rear edge 18, a top edge 20 and a bottom edge 22. Similarly, the side panel 14 includes a front edge 24, a rear edge 26, a top edge 28 and a bottom edge 30.

A front panel 32 is located at a front portion of the box 10 and includes a top edge 34, a bottom edge 26 and side edges which are common with and connected to the front edges 16 and 24 of the side panels 12, 14.

A back panel 37 is provided including a top edge 38, a bottom edge 40, and a pair of side edges which are common with and connected to the rear edges 18 and 26 of the side panels 12, 14.

Figure 1A:
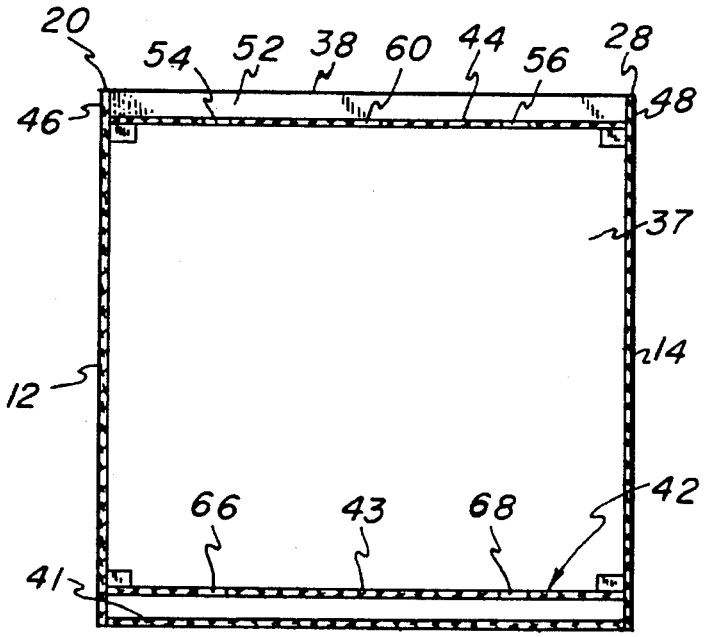
FIG. 1A is a cross-sectional view taken along line 1A—1A in FIG. 1.

As seen in FIGS. 1 and 1A, a lower support structure 42 is located on a bottom side of the box 10. The lower support structure 42 includes a bottom panel 41 connected to the side panels 12, 14, front panel 32 and back panel 37 adjacent to the bottom edges 22, 30, 36 and 40, respectively. In addition, the lower support structure 42 includes an alignment panel 43 located above the bottom panel 41. The alignment panel 43 is engaged with the side panels 12, 14 and the front and back panels 32 and 37, and includes means for aligning implements displayed in the box 10, as is described further below.

A top panel 44 is located at a top side of the box 10 and is attached to the side panels 12, 14, front panel 32 and back panel 37 adjacent to the top edges 20, 28, 34 and 38, respectively. It should be noted that the upper edges 20, 28, 34, 38 define respective upper lip portions 46, 48, 50, 52 which extend upwardly from the top panel 44.

Figure 2:
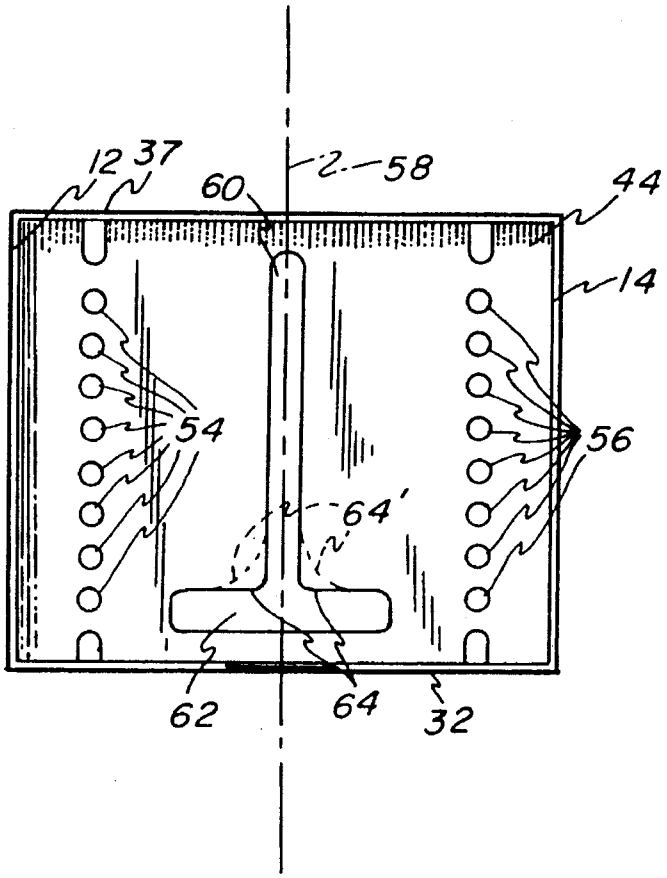
FIG. 2 is a top plan view thereof.

Referring to FIGS. 1 and 2, the top panel 44 includes a plurality of apertures 54 arranged in a first row extending in a front to rear direction, and a plurality of apertures 56 arranged in a second row also extending in a front to rear direction parallel to the first row of apertures 54. The rows of apertures 54 and 56 are located in spaced relation to each other on either side of a front to rear centerline 58 of the top panel 44. The apertures 54, 56 are sized to receive handles of implements therethrough wherein the handles may be inserted with a head portion of the implement oriented upwardly.

An elongated slot 60 is defined in the top panel 44 extending in a front to rear direction along the centerline 58. An enlarged transverse slot 52 is also defined in the top panel 44 adjacent to the front panel 32. The transverse slot 62 extends in a transverse direction substantially perpendicular to the elongated slot 60. The elongated slot 60 is sized to receive the handles of implements and the transverse slot 62 is sized to permit passage of the head portions of implements through the top panel 44. Thus, the head portions of implements may be passed through the slot 62 into the enclosure area defined between the various panels 12, 14, 32, 37, 43, 44 defining the box 10, and the elongated slot 60 permits the implements to be either positioned rearwardly in the box or moved forwardly for removal from the box. It should be noted that although the transverse slot 62 is shown having a substantially rectangular shape, the rear edges 64 of the slot 62 may be modified and cut back to the location depicted by slot edges 64' in order to facilitate insertion and removal of the head portion of the implements through the top panel 44 by providing an additionally wide opening.

As may be best seen in FIG. 1, the alignment panel 43 includes a first plurality of openings 66 and a second plurality of openings 68 arranged in first and second rows, respectively. The first plurality of openings 66 is aligned with the apertures 54 in the top panel 44 and the second plurality of openings 68 is aligned with the apertures 56. The openings 66, 68 are adapted to receive the end portions of implement handles in order to maintain the implements passing through the apertures 54, 56 in a vertical orientation.

Figure 3:
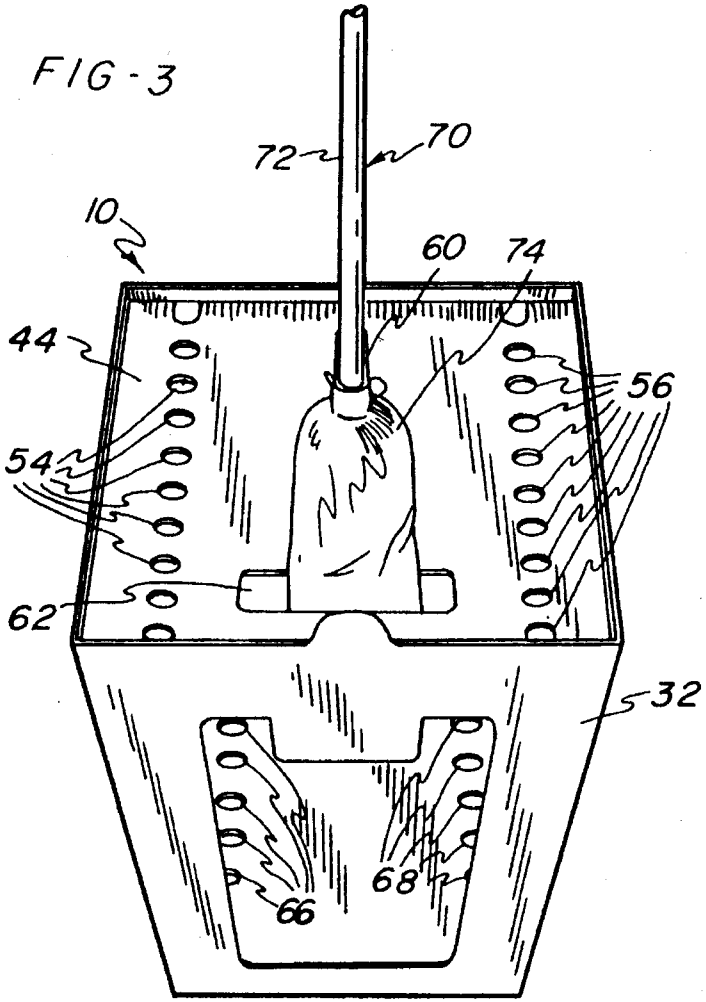
FIG. 3 is a perspective view illustrating a mop passing through the top panel of the merchandising and shipping box.

Referring to FIG. 3, an implement comprising a mop 70 having an elongated handle 72 and a head portion 74 is illustrated passing through the transverse slot 62 for the box 10. It should be apparent that the enlarged transverse slot 62 provides a convenient access aperture for permitting passage of the mop head 74 while the elongated slot defines a passage in sufficiently close conformance to the handle dimension 72 to maintain the mop 70 in an upright position once it is positioned within the box 10.

Figure 4:
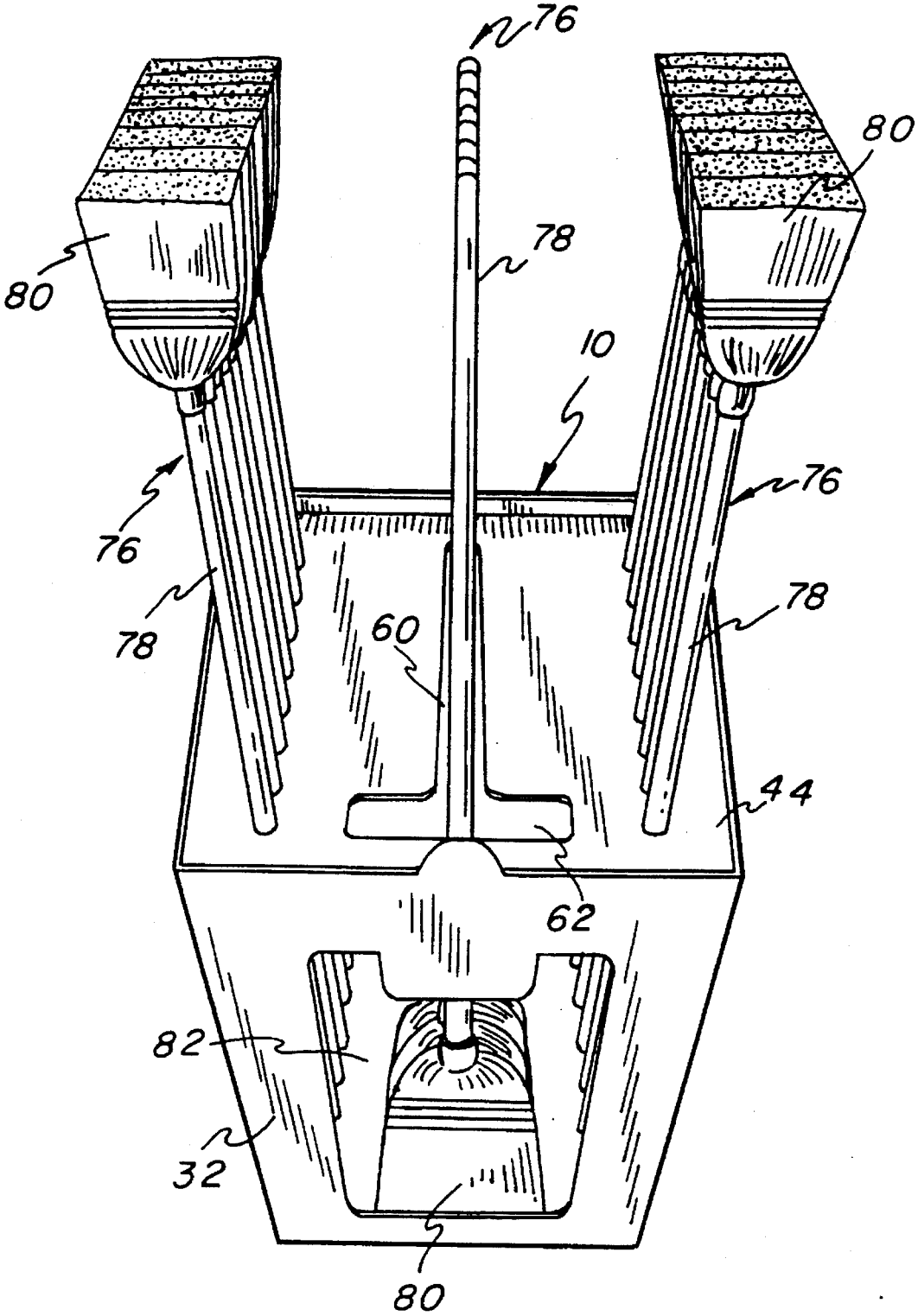
FIG. 4 is a perspective view of the merchandising and shipping box with brooms placed therein.

FIG. 4 illustrates the box 10 with a plurality of implements in the form of brooms 76 organized in a typical arrangement for displaying the brooms 76. The brooms 76 located within the slot 60 are oriented with handles 78 thereof positioned upwardly and head portions 80 positioned downwardly. Brooms 76 located on either side of the slot 60 and passing through the apertures 54, 56 are oriented with the handles 78 positioned downwardly through the apertures 54, 56 and openings 66, 68 and the head portions 80 positioned upwardly. The brooms 76 positioned in the slot 60 operate to counteract any tipping forces which may result from the orientation of the brooms in the apertures 54, 56 having their head portions 80 positioned upwardly.

Further, it should be noted that the front panel 32 is provided with a cutout area 82 which permits the portion of the brooms 76 located within the enclosure of the box 10 to be viewed by customers.

It should also be noted that although two rows of apertures are described for receiving the handles, additional rows of apertures may also be provided within the scope of the present invention.

From the above description it should be apparent that the present invention provides a merchandising and shipping box which facilitates an organized arrangement of implements within the box and which facilitates viewing of the implements when on display. Further, the present box facilitates insertion and removal of implements, such as mops and brooms to and from the box while also providing a stable support for the implements while they are on display.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A merchandising and shipping box for implements having a handle and a head portion, said box comprising:

a plurality of vertical panels having top edges, and side edges connected to define an enclosure;

a top panel connected to said vertical panels adjacent to said top edges;

a plurality of apertures formed in said top panel for receiving handles of implements with head portions of the implements positioned above said top panel;

an elongated slot in said top panel for receiving a plurality of handles of implements; and a transverse slot portion extending transversely to a direction of extension of said elongated slot, said transverse slot portion facilitating insertion of head portions of the implements past said elongated slot and into said enclosure.

2. The box as recited in claim 1 wherein said apertures are aligned in at least one row and said elongated slot extends parallel to said at least one row of apertures.

3. The box as recited in claim 1 including a bottom panel connected to said vertical panels at bottom edges of said vertical panels.

4. The box as recited in claim 1 wherein said vertical panels comprise a pair of opposing side panels, a back panel connected to rear edges of said side panels and a front panel connected to front edges of said side panels.

5. The box as recited in claim 4 wherein said front panel includes a central cut out area for facilitating viewing into said enclosure.

6. The box as recited in claim 1 including a bottom panel connected said vertical panels, and alignment openings at said bottom panel aligned with said apertures for receiving end portions of handles passing through said apertures.

7. The box as recited in claim 1 wherein said top panel and vertical panels are formed of cardboard.

8. A merchandising and shipping box for implements such as mops and brooms having a handle and a head portion, said box comprising:

a pair of opposing side panels having front, rear, top, and bottom edges;

a front panel having top and bottom edges and side edges connected to said front edges of said side panels to define an enclosure;

a top panel located adjacent to said top edges, said top panel including spaced rows of apertures extending in a front to rear direction for receiving handles of implements;

an elongated slot formed in said top panel extending in said front to rear direction for receiving handles of implements; and an enlarged opening at one end of said elongated slot and connected to said elongated slot for facilitating insertion of head portions of the implements into said enclosure.

9. The box as recited in claim 8 wherein said elongated slot is located centrally in said top panel.

10. The box as recited in claim 8 wherein said enlarged opening comprises a transverse slot connected to said elongated slot.

11. The box as recited in claim 8 wherein said front panel includes a central cut out area for facilitating viewing into said enclosure.

12. The box as recited in claim 8 including a bottom panel connected to said bottom edges of said side panels and said front panel.

13. The box as recited in claim 8 including a back panel connected to said rear edges of said side panels.

14. The box as recited in claim 13 including alignment openings at said bottom panel aligned with said apertures for receiving end portions of handles passing through said apertures.

15. A cardboard merchandising and shipping box for implements including mops and brooms having a handle and a head portion, said box comprising:

a pair of opposing side panels having front, rear, top and bottom edges;

a front panel having top and bottom edges and side edges connected to said front edges of said side panels;

a back panel having top and bottom edges and side edges connected to said rear edges of said side panels;

a bottom panel located adjacent to said bottom edges;

a top panel located adjacent to said top edges;

spaced rows of apertures formed in said top panel and extending in a front to rear direction for receiving handles of implements;

an elongated slot formed in said top panel and extending between said rows of apertures in said front to rear direction for receiving handles of implements;

a transverse slot extending substantially perpendicular to said front to rear direction and connected to said elongated slot for facilitating insertion of the head portions of the implements through said top panel;

alignment openings at said bottom panel aligned with said apertures for receiving end portions of handles passing through said apertures; and a central cut out area in said front panel for facilitating viewing portions of implements located within said box.

* * * * *